United States Patent [19]

Glassford, Jr.

[11] 4,383,467

[45] May 17, 1983

[54] SNARE DRUM MODULATOR

[76] Inventor: William E. Glassford, Jr., 56 Jefferson St., P.O. Box 312, Westville, Ind. 46391

[21] Appl. No.: 278,877

[22] Filed: Jun. 29, 1981

[51] Int. Cl.[3] ..... G10D 13/02

[52] U.S. Cl. ..... 84/415

[58] Field of Search ..... 84/415, 417

[56] References Cited

U.S. PATENT DOCUMENTS

| | | | |
|---|---|---|---|
| 1,722,032 | 7/1929 | Bower . | |
| 1,724,888 | 8/1929 | Strupe . | |
| 1,828,083 | 10/1931 | Strupe | 84/415 |
| 2,198,406 | 4/1940 | Deans et al. | 84/419 |
| 2,261,120 | 11/1941 | Ludwig et al. | 84/415 |
| 2,295,479 | 9/1942 | Jeffries | 84/415 |
| 2,517,144 | 8/1950 | Strupe | 84/415 |
| 3,113,481 | 12/1963 | Thompson | 84/415 |
| 4,018,130 | 4/1977 | Gariepy | 84/415 |
| 4,138,920 | 2/1979 | Meador | 84/415 |
| 4,339,982 | 7/1982 | Hoshino | 84/415 |

FOREIGN PATENT DOCUMENTS

| | | | |
|---|---|---|---|
| 1019171 | 2/1966 | United Kingdom | 84/415 |

*Primary Examiner*—Lawrence R. Franklin

*Attorney, Agent, or Firm*—McDougall, Hersh & Scott

[57] ABSTRACT

A device for adjusting the tension of snares which are disposed diametrically across the outer face of a drum head includes a support bracket for securing the device to the exterior surface of a drum shell, an operating handle pivotally connected to the support bracket comprising a lever and an extension arm for movement relative to the drum shell, and tensioning means comprising a biased roller assembly connecting the operating handle to the drum shell and to the snares whereby the tension of the snares and their position relative to the drum head can be changed by movement of the operating handle so that the frequency of vibration or pitch at the drum head and, therefore, the sound of the drum can be controlled while the drum is being played.

4 Claims, 7 Drawing Figures

SNARE DRUM MODULATOR

BACKGROUND OF THE INVENTION

The present invention relates in general to a device for controlling the pitch or tone of a snare drum and, in particular, to a device for continuously adjusting the tension of snares which contact a drum head to control the frequency of vibration at the drum head and, therefore, the sound produced by the drum.

A snare drum is a double-headed drum comprising a hollow cylindrical shell closed at each end by skins or heads that are stretched around the peripheries of the shell and tightened by means of keys and adjustable bolts or the like. A series of tightly coiled metal wires or snares is disposed diametrically across the outer face of the lower or snare head of the drum. In conventional practice, the set of snares is held taut by a screw-type tensioning device. Since the tension of the snares cannot be adjusted while the drum is being played, the drum produces a single tone or pitch.

It should be noted that in all snare drums the frequency of vibration of the upper or batter head is controlled by the tension of the batter head, the lower or snare head and the snares. The strength of the blows to the batter head also influences the tone or pitch produced. This technique of varying the drum tone by increasing or decreasing the force of the blow to the batter head, however, requires a considerable degree of skill on the part of the drummer. As used herein the term "pitch" describes only the results obtained by changing the tension of the snares and their position relative to the snare head, rather than changes in the loudness of the note or the tension of the drum heads.

Over the years, improved tensioning devices have been developed which can displace a set of snares axially relative to a drum head and cause the snares to contact the head or to move away therefrom so that the tone of the drum can be changed. Only a limited number of tones, however, can be produced by a drum having this arrangement since one of two extremes are possible—the snares either contact the snare head or they do not.

These devices which effect axial displacement of the snares usually include levers positioned on the drum shell at points readily accessible to the hand or drum stick of the drummer. The levers are connected to assemblies within the drum shell for displacing or tensioning the snares. As with a conventional screw-type tensioning device, this construction usually requires the drummer to stop playing to operate the lever and tune the drum to the desired tone or pitch. Such devices are described below.

DESCRIPTION OF THE PRIOR ART

The following references constitute the closest prior art of which applicant is aware.

U.S. Pat. No. 1,722,032 to Bower discloses a foot pedal in communication with a strap for adjusting the tension of drum snares. The foot pedal can be operated to produce either muffled or snare effects on the drum.

U.S. Pat. No. 1,724,888 to Strupe shows a device for displacing snares from a snare head by means of a handle that controls the snare tension. In a similar manner, U.S. Pat. No. 1,828,083 to Strupe describes a device having a toggle lever or handle which can be operated by hand or upon striking with a drum stick. U.S. Pat. No. 2,517,144 also to Strupe is another variation of that concept.

U.S. Pat. No. 2,198,406 to Deans et al. discloses an assembly mounted within a drum shell in communication with a foot pedal for angularly displacing a rod to move the snares away from the snare head. While Deans et al. state that an infinite variety of drum tones can be obtained as the drum is being played, that device is mounted within the drum and requires removal of a drum head for installation. The present device, however, can be mounted to the exterior surface of a drum shell without removal of a drum head.

U.S. Pat. No. 2,261,120 to Ludwig et al. relates to a mechanism for positioning one of two sets of snares against a snare head. The tension of the snares, however, is not adjusted; rather the snare sets can be selectively brought into contact with the snare head by a hand operated lever.

Accordingly, it will be noted that the prior art includes several devices which can be used to produce different drum tones or resonant effects; but most of the referenced devices can produce only two drum tones and no device can be mounted to the exterior surface of a drum shell as easily as the present device which can be fastened to the exterior of any conventional snare drum to produce an infinite variety of tones.

SUMMARY OF THE INVENTION

The present invention overcomes the disadvantages of previously designed snare control devices by permitting a drummer to change the pitch of a snare drum as the drum is being played. A drummer often uses a number of differently tuned snare drums to obtain a range of effects and tones. The present device is attached to the exterior of a snare drum shell to replace a conventional snare tensioning means and so to increase the range of tones produced by a single snare drum. Indeed, an infinite range of tones can be continuously produced from a single drum by use of this invention.

The device includes a support bracket for securing the components to a drum shell, an operating handle pivotally connected to the support bracket comprising a lever and an extension arm for movement relative to the drum shell, and tensioning means comprising a biased roller assembly connecting the operating handle to the drum shell and the snares whereby the tension of the snares and their position relative to the drum head can be changed by movement of the operating handle. In this manner, the frequency of vibration or pitch of the drum can be continuously adjusted while the drum is being played.

DETAILED DESCRIPTION OF THE INVENTION

Figures 1, 2, 5:
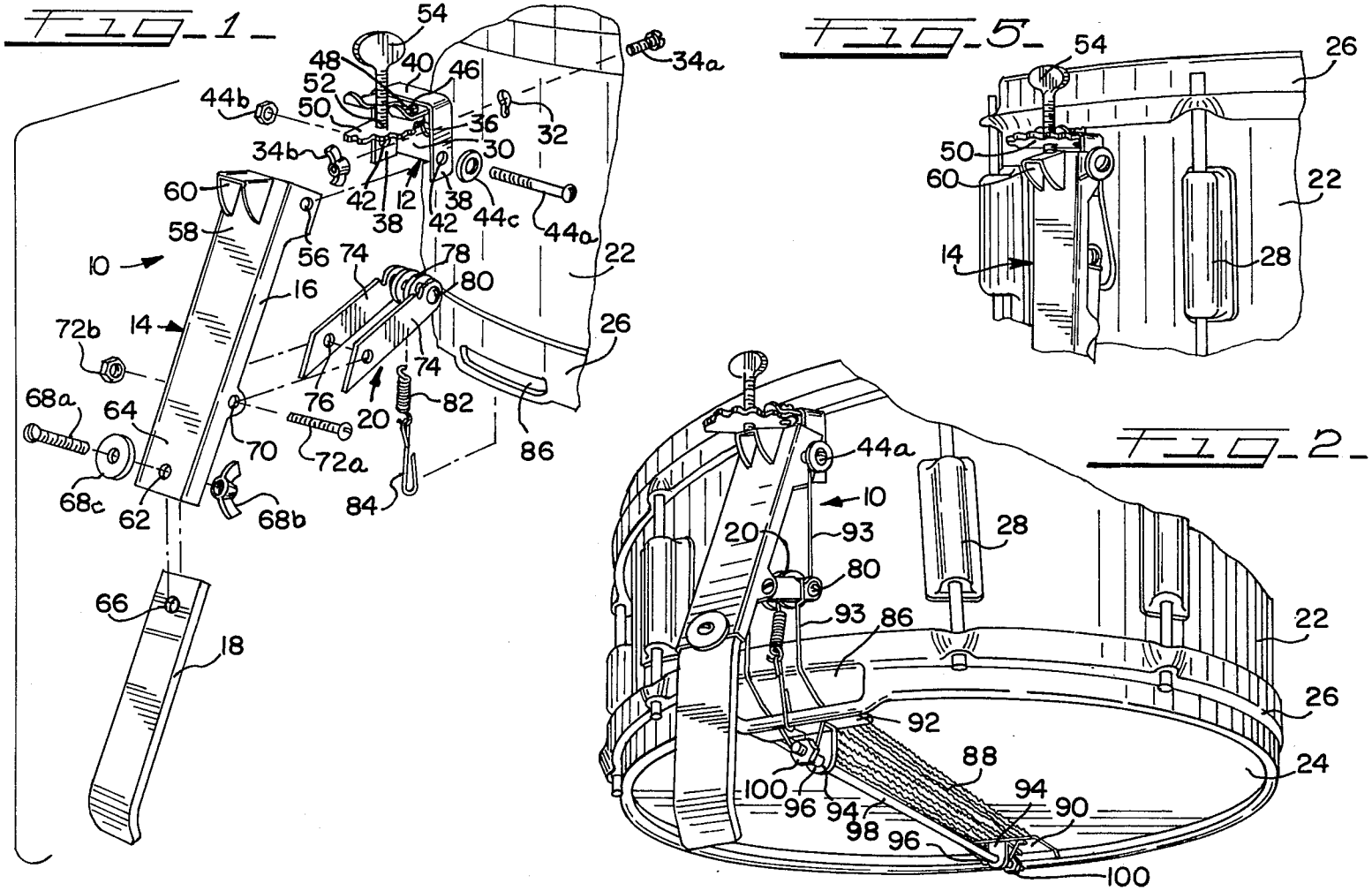
FIG. 1 is an exploded perspective view of the device of the present invention.
FIG. 2 is a perspective view of the device showing the snares disposed diametrically across the outer face of the lower drum head.
FIG. 5 is a perspective view of the operating handle locked in the closed position.

Referring to FIGS. 1 and 2, the device of the present invention which is indicated generally by reference numeral 10 comprises a support bracket 12, an operating arm 14 which includes a lever 16 and a lever extension 18, and a tensioning means comprising a biased roller assembly 20 that contacts a drum shell 22. The device can be mounted on the exterior surface of the drum shell 22 to permit the tone or pitch of the drum to be changed while the drum is being played.

A snare drum includes an upper batter head (not shown) and a lower snare head 24 (see FIG. 2) which are secured to the drum shell 22 in a conventional manner by means of an annular ring 26 surrounding each end of the drum shell. The tension of the heads is adjusted by a plurality of axial bolt assemblies 28 which cooperate between the annular rings 26 to secure the batter and snare heads.

The device 10 is mounted to the drum as described below with particular reference to FIG. 1. The support bracket 12 includes a rear plate 30 having a slight curvature that corresponds with the circumference of the drum shell 22. A keyed opening 32 in the drum shell 22 receives the head of a bolt 34*a* which passes through a hole 36 in the rear plate 30 and which is secured by a wing nut 34*b* to fasten the device 10 to the drum shell without the removal of the drum heads. In the alternative, a toggle bolt assembly can be used.

The support bracket 12 also includes side and top flanges 38 and 40, respectively. Each side flange 38 has an opening 42 for receiving a hinge bolt 44*a* secured by a nut 44*b* so that the bolt extends through the support bracket and the lever 16 of the operating arm 14. If desired, a washer 44*c* can be inserted between the head of the bolt and the side flange 38. Connected to the top flange 40 is a lip 46 which has a threaded hole (not shown) for receiving a screw 48 to rotatably fasten a plate 50 to the lip 46 of the support bracket 12. The plate 50 includes a threaded bore 52 for receiving a clamp screw 54. Alternatively, the top flange 40 and the lip 46 can be formed of a single piece. The plate 50 can swing 180° so that the clamp screw 54 clears the operating arm 14. In preferred practice, the clamp screw 54 has a right hand thread and the plate 50 is hinged to rotate clockwise towards the top flange 40. In this manner, the clamp screw can be adjusted with one hand, and the plate will not rotate from the applied force as the clamp screw is tightened.

The lever 16 includes a passage 56 at the upper end 58 thereof for receiving the hinge bolt 44*a* to pivotally secure the operating arm 14 to the support bracket 12 as previously described. The upper end 58 of the lever also includes a shoulder section 60 which, as will be described, can cooperate with the clamp screw 54 to hold the operating arm in a given position relative to the drum.

A second passage 62 through the lower end 64 of the lever and a hole 66 in the lever extension 18 receive a bolt 68*a* secured to a wing nut 68*b* to secure the lever extension 18 to the lever. A washer 68*c* may be used. Because the lever and lever extension are separate pieces, the operating arm 14 can be dismantled by loosening the wing nut 68*b* and removing the lever extension 18 for packing and transporting the drum. The operating arm is simply contracted or pressed flush against the drum shell 22. The clamp screw 54 is then tightened to engage the shoulder section 60 of the lever and lock the operating arm in that position. In the alternative embodiment, the lever and lever extension can comprise a single member.

An additional passage 70 through the lower end 64 of the lever receives a bolt and nut 72*a* and 72*b*, respectively, to rotatably connect the biased roller assembly 20 to the tensioning means to the lever 16. Specifically, a pair of elongated members 74 include holes 76 at one end thereof which correspond with the passage 70 in the lower end 64 of the lever. The elongated members can be tapered at the end having the holes 76 to define the maximum arc of rotation between the lever 16 and the roller assembly. Cylinders or rollers 78 rotatably mounted to a shaft 80 at the other end of the elongated members 74 are adapted to engage the drum shell 22 and move thereon in response to movement of the operating arm 14. A spring 82 and a clip 84 join the elongated members 74 to an opening 86 in the lower annular ring 26 of the drum. In this manner, tension is maintained and pressure against the operating arm 14 is required to move the arm in the direction of the drum shell.

Referring now to FIG. 2, the device 10 is shown mounted to the exterior surface of the drum shell 22. Snares 88 are secured in a conventional manner between the snare ends 90 and 92 with one snare end 90 being inserted between the snare head 24 and the lower annular ring 26 opposite the opening 86. A non-elastic cord 93 passes through the opening 86 to connect the other snare end 92 to the shaft 80 of the biased roller assembly 20 and to the bolt 44*a* which pivotally connects the operating arm 14 to the support bracket 12.

Each snare end 90 and 92 includes a brace 94 having an opening 96. A rod 98 having stops 100 at each end thereof passes through the opening 96 of the brace 94 on each snare end. The function of the rod will be more fully explained with reference to FIGS. 6 and 7. In short, however, the purpose of the rod is to tense the snares for contact at the middle of the snare head only so that a wider range of tones can be produced by the drum.

Figure 3:
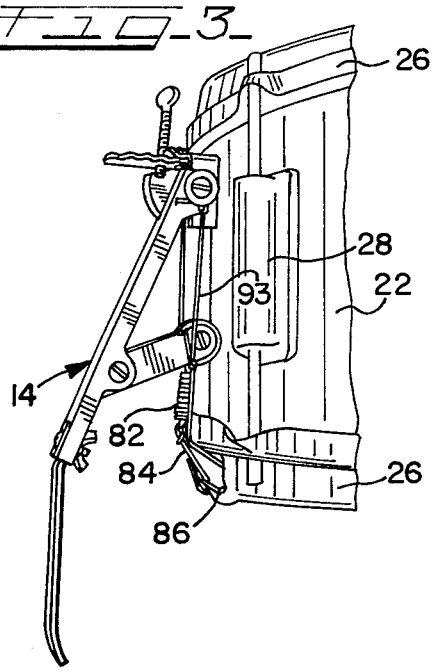
FIG. 3 is a side elevational view of the device in the open or extended position.
Figure 4:
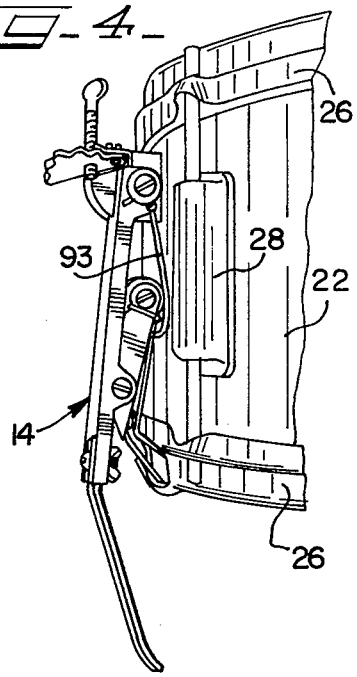
FIG. 4 is a side elevational view of the device in the closed or contracted position.

FIG. 3 shows the device with the operating arm 14 extended so that the snares do not contact the snare head (hereinafter referred to as the "open" position). FIG. 4, on the other hand, illustrates the device with the operating arm 14 contracted or moved toward the drum shell 22 so that the snares are in direct contact with the center of the snare head (hereinafter referred to as the "closed" position). There are, of course, an infinite number of positions between these two extremes. Each position places a slightly different strain on the snares so that the number of tones which can be achieved upon moving the operating arm and then striking the upper or batter head of the drum are unlimited.

Referring now to FIG. 5, the device is shown locked in the closed position by the clamp screw 54 that engages the shoulder section 60 of the operating arm 14. By turning the clamp screw 54 in either direction, i.e., clockwise or counterclockwise, the tension of the snares can be changed to produce a corresponding change in the tone of the drum. Therefore, a drum can be tuned and once the desired pitch is produced, the tension of the snares can be maintained so that the same sound is produced repeatedly.

Figure 6:
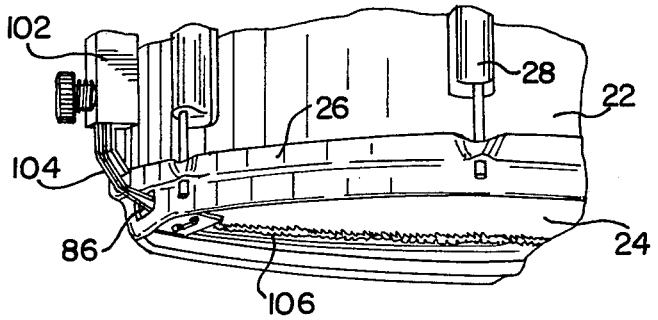
FIG. 6 is a perspective view of a conventional snare assembly with a screw-type tensioning means.

FIG. 6 shows a conventional snare assembly. A housing 102 contains a cord 104 which is connected to one end of a set of snares 106. Screw tightening means within the housing is used to control the tension of the snares. Note that each end of the snares contacts the snare head and that the snares sag in the middle. This limits the range of tones which can be produced by the drum.

Figure 7:
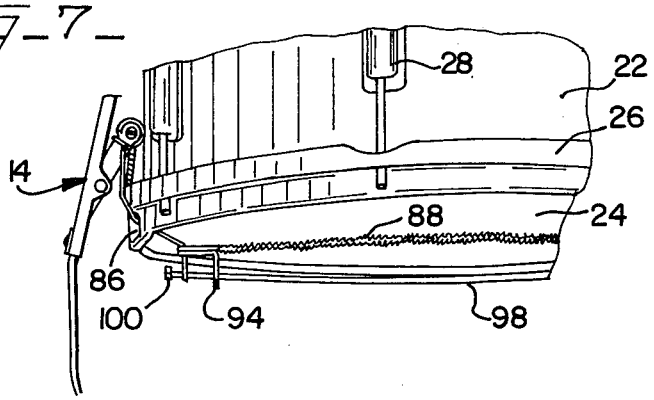
FIG. 7 is a perspective view of a snare assembly according to the present invention.

FIG. 7, however, shows the device of the present invention in a partially closed position so that the snares are stretched taut and the rod 98 and the snare ends 90 and 92 cooperate so that the snares contact the middle of the snare head. Because the snares contact the center of the drum, a wider range of tones can be produced upon striking the batter head.

It should be noted that a drummer can use the present device from the standing or sitting position. In either case, the knee of the drummer applies the force necessary to move the operating arm towards the drum shell. Because the pressure on the operating arm may cause the drum to tip if a tripod is the only means of support for the drum, additional bracing means should be provided to support the drum. This can be accomplished in conventional fashion by placing the snare drum between several other drums when playing or by providing a more sturdy stand for the drum.

It will be understood that various changes and modifications can be made in the construction described without departing from the spirit of the invention, particularly as defined in the following claims.

That which is claimed is:

1. A device for adjusting the tension of snares extending diametrically across a head of a snare drum shell comprising:

(a) a support bracket which can be secured to an opening in the drum shell to mount the device to the exterior of the drum without removal of the drum head;

(b) an operating handle pivotally connected to said support bracket for movement relative to the drum; and (c) tensioning means operatively connecting said operating handle to the drum and the snares, said tensioning mean including a biased roller assembly comprising an elongated member with a first end pivotally connected to said operating handle and a second end including a roller which contacts the drum shell, said biased roller assembly further comprising a spring joining the second end of the elongated member to the drum shell to maintain tension between the operating handle and the drum shell as the operating handle is moved whereby movement of the operating handle relative to the drum changes the tension of the snares and displaces the snares axially relative to the head to modulate the pitch of the drum as the drum is being played.

2. A device in accordance with claim 1 wherein the first end of the elongated member is tapered so that engagement of the first end and the operating handle defines the maximum arc of rotation between the operating handle and the biased roller assembly.

3. A device in accordance with claim 1 wherein the pitch of the drum can be modulated within an infinite range.

4. A device in accordance with claim 1 wherein said operating handle includes a shoulder section and said support bracket includes gripping means to engage the shoulder section and lock the operating handle in position relative to the drum shell.

* * * * *